United States Patent [19]

Dewaele

[11] Patent Number: 4,821,916

[45] Date of Patent: Apr. 18, 1989

[54] DEVICE FOR DISPENSING AND VENDING FLEXIBLE SUPPORTS

[76] Inventor: Renee Dewaele, 17, rue de la Scierie, 67115 Plobsheim, France

[21] Appl. No.: 44,027

[22] PCT Filed: Jul. 25, 1986

[86] PCT No.: PCT/FR86/00266

§ 371 Date: May 20, 1987

§ 102(e) Date: May 20, 1987

[87] PCT Pub. No.: WO87/00664

PCT Pub. Date: Jan. 29, 1987

[30] Foreign Application Priority Data

Jul. 26, 1985 [FR] France ..... 85/11580

[51] Int. Cl.[4] ..... G07F 11/14; B65H 1/16

[52] U.S. Cl. ..... 221/13; 221/198; 221/231; 221/225; 221/258; 221/259; 221/282; 312/61; 312/71

[58] Field of Search ..... 221/213, 214, 215, 216, 221/231, 258, 259, 225, 135, 286, 197, 198, 282, 232, 13, 283; 101/47, 71, 316, 371; 312/50, 61, 71; 156/442

[56] References Cited

U.S. PATENT DOCUMENTS

| | | | |
|---|---|---|---|
| 1,073,515 | 9/1913 | Peters | 156/442 X |
| 2,486,841 | 11/1949 | Harris et al. | 221/213 X |
| 2,996,219 | 8/1961 | Tsai | 221/259 |
| 3,655,092 | 4/1972 | Hall et al. | 221/258 X |
| 3,753,514 | 8/1973 | Naguet | 221/129 |
| 4,108,333 | 8/1978 | Falk et al. | 221/13 |
| 4,209,108 | 6/1980 | Winans | 221/6 |
| 4,717,043 | 1/1988 | Groover et al. | 221/231 X |

FOREIGN PATENT DOCUMENTS

| | | | |
|---|---|---|---|
| 2522353 | 12/1976 | Fed. Rep. of Germany | 221/259 |
| 294720 | 9/1949 | France | 221/213 |
| 1535685 | 8/1968 | France . | |
| 2070021 | 9/1971 | France . | |
| 2188219 | 1/1974 | France . | |
| 2231057 | 12/1974 | France . | |
| 1213672 | 11/1970 | United Kingdom . | |
| 1403396 | 8/1975 | United Kingdom | 221/231 |

*Primary Examiner*—Joseph J. Rolla
*Assistant Examiner*—Stephen B. Parker
*Attorney, Agent, or Firm*—Young & Thompson

[57] ABSTRACT

A coin-operated dispenser for flexible supports such as postcards, comprises an element (1) shaped like a piece of furniture closed on three sides comprising a juxtaposition and a superposition of compartments (2) each containing a packet of flexible supports and apparatus for distributing individual supports, an assembly (3) for selection of and payment for the flexible supports, and a device (4) for closing the face of the element (1), provided at the upper part of each compartment (2) with a dispensing opening (5), and beneath this opening (5) with a housing (6) for receiving a display sample (7) of the flexible support contained in the corresponding compartment (2).

4 Claims, 2 Drawing Sheets

DEVICE FOR DISPENSING AND VENDING FLEXIBLE SUPPORTS

The present invention concerns the field of dispensing flexible supports such as postcards, envelopes or the like, and has for an object a device for dispensing and vending such supports.

At present, the dispensing and vending of flexible supports such as postcards, envelopes and the like generally requires the presence of at least one person. Specifically, postcards are mounted in a fixed or rotatable display rack which permit the customers to select and pay for their purchases simply by walking to the counter. Such a distribution method also has the disadvantage of requiring the constant attention of the sales personnel to guard against theft of the said cards, or the like.

The present invention has as an object to overcome these disadvantages.

Specifically, it has as an object a device characterized in that it is essentially constituted by an element formed like a piece of furniture closed on three sides comprising a juxtaposition and superposition of compartments each containing a packet of flexible supports and a means for distributing individual supports, via an assembly for selection and payment of the flexible supports, and by a device for closing the front face of the element provided, at the level of the upper portion of each compartment, with a dispensing opening, and beneath this opening a housing for receiving a sample of the flexible support contained in the corresponding compartment.

The invention will be best understood thanks to the following description, which refers to preferred embodiments, given by way of non-limiting example and explained with reference to the accompanying schematic drawings, in which.

Figure 1:
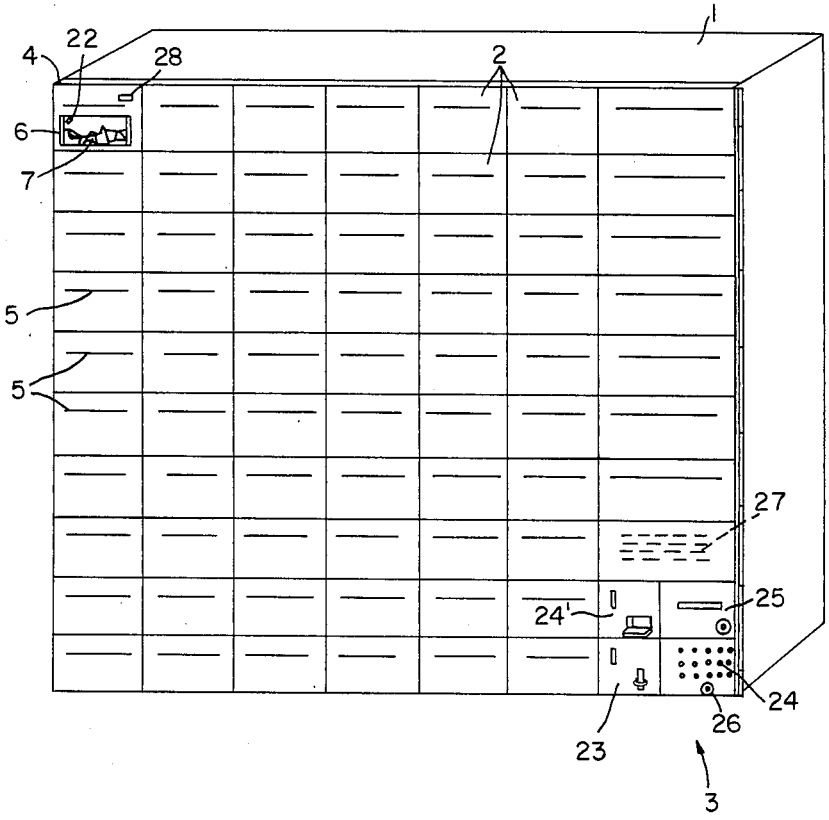
FIG. 1 is a perspective view of the device according to the invention.

According to the invention, and as shown more particularly by way of example in FIG. 1 of the accompanying drawings, the device is essentially constituted by an element 1 in the form of a piece of furniture closed on three sides and which comprises juxtaposed and superposed compartments 2, these compartments 2 each containing a packet of flexible supports and a means for distribution of individual said supports. The device according to the invention moreover comprises an assembly 3 for selection and payment of the flexible supports and a device 4 for closing the forward face of the element 1 provided, at the level of the upper part of each compartment 2, with a dispensing opening 5, and beneath this opening 5 a housing 6 for receiving a display sample 7 of the flexible support contained in the corresponding compartment 2.

Figure 2:
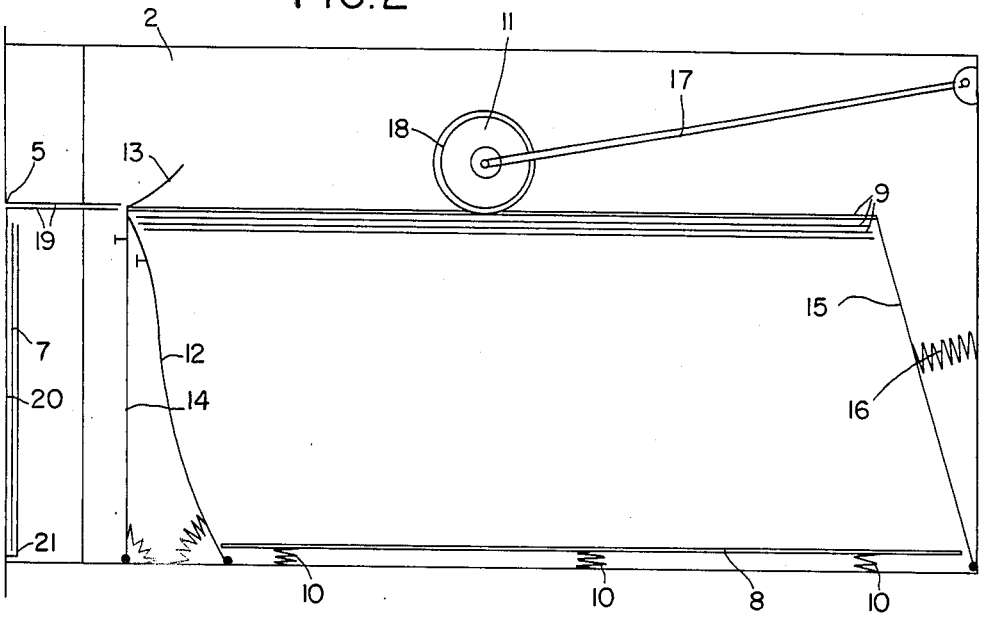
FIG. 2 is a longitudinal sectional view on a larger scale of a compartment.

As shown in FIG. 2, each compartment 2 is provided with a movable base 8 receiving the flexible supports 9 and urged by springs 10, an individual distribution means 11 in the form of a movably mounted drive roller, a forward inclined plate 12 pivotally mounted on the base of the compartment 2 and bearing, in its service position, against the base of an outlet hopper lip 13 connected to the dispensing opening 5 of the closure device 4, a movable access plate 14 also mounted on the base of the compartment 2, maintaining, in its closed position, the inclined plate 12 in its service position, and a rear push-plate 15 urged by a spring 16 and bearing on the packet of supports 9.

The drive roller 11 is mounted on the end of an arm 17, the other end of which is connected in the upper part of the compartment 2, is actuated by means of a coaxial stepping motor (not shown) fixed to the arm 17, and is provided with a coating 18 having a high friction coefficient. This coating may be in the form of a layer of rubber, synthetic material or the like, and is intended to permit displacing a support 9 disposed at the top of the packet in the direction of the outlet hopper lip 13 and thus toward the dispensing opening 5.

The dispensing openings 5, one for each compartment 2, are advantageously in the form of parallel plates 19 fixed on the closure device 4, extending from the external face of this latter to the outlet hopper lip 13, and of a spacing slightly greater than the thickness of the flexible supports 9.

The closure device 4 is in the form of a door connected to one edge of the element 1 and is provided beneath each opening 5 with a transparent plate 20 closing the exhibition housing 6 for the sample support 7, this housing 6 being formed as a receiving frame 21 applied against the internal face of the device 4, and each housing 6 is provided, preferably in one corner of the plate 20, with a reference numeral 22.

The compartments 2 either all have the same width, thus permitting housing identical supports, or have widths varying as a function of the size of the supports.

The assembly 3 for selection of and payment for flexible supports is preferably constituted by a coin receiver 23 and by an electronic selection keyboard 24 that is controlled by the coin receiver 23 and in turn controls, through the intermediary of a microprocessor, the actuation of the motor for the drive roller 11 of the compartment enclosing the selected flexible support 9, this assembly 3 being completed by a change dispenser 24' and by a stamper 25, and being mounted in the element 1 according to the overall dimensions corresponding to an alignment or a grouping of the compartments 2, the corresponding front surface being cut off in the closure device 4.

Moreover, according to another characteristic of the invention, the assembly 3 for selection and payment may be disposed either on a side face of the element 1, or on a separate console.

The assembly 3 may moreover be completed by a luminous indicator 26 supplied with voltage and by instructions 27 on its face.

Moreover, each compartment 2 is provided with a counter 28 connected to an audible or luminous alarm device to signal that the packet of supports 9 has been exhausted.

The device according to the invention operates in the following manner:

After introduction into the coin receiver 23 of the necessary tokens, the numeral corresponding to the selected support may be entered on the keyboard 24 which sends a control pulse to the motor of the drive roller 11 of the corresponding compartment 2, such that the support 9 is transported from the said compartment 2 through the opening 5 by rotation of the motor one step, and is counted by the corresponding counter 28. In the case where the support 9 requires stamping, this latter will thus be introduced in the stamper 25.

According to an embodiment of the invention, the device may also be equipped with connected compartments controlled separately or simultaneously for distribution of means for receiving and sending the support and/or marking means. Thus it is particularly possible simultaneously to distribute a card, a fountain pen or the like for writing on the said card, and an envelope.

Figure 3:
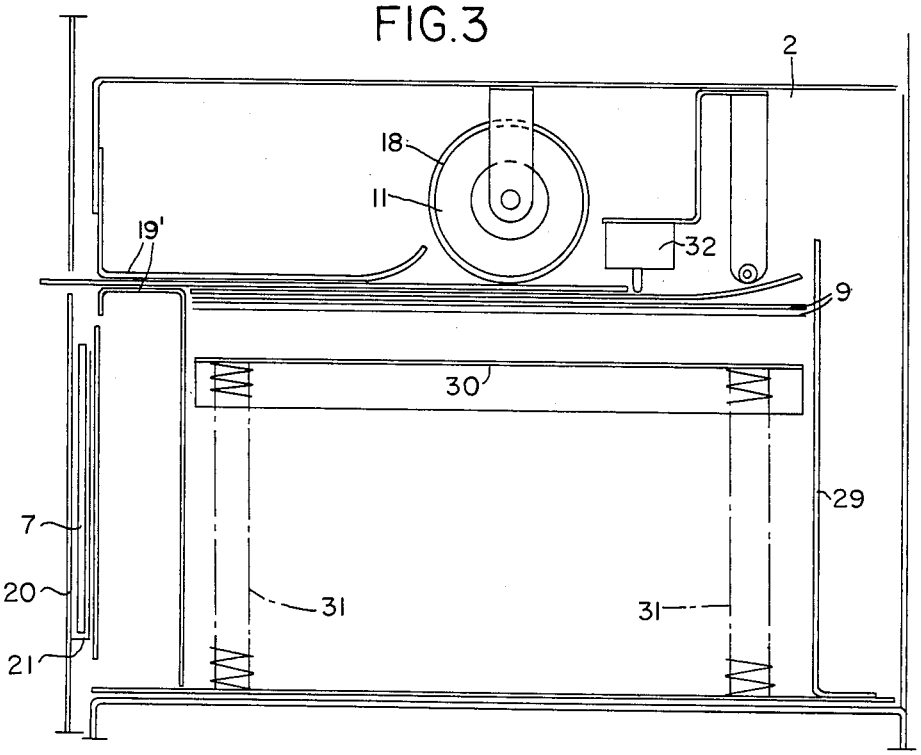
FIG. 3 is a view similar to that of FIG. 2, of a variation according to the invention.

According to another embodiment of the invention, and as is shown in FIG. 3, each compartment 2 is provided with a drawer 29 introduced through the rear face of the element 1, and in which the supports 9 are mounted on a movable base 30 against the action of springs 31, the drive roller 11 with its motor being fixed against the upper wall of the compartment 2, and a micro-contact 32 controlling stoppage of the said motor, this micro-contact being disposed behind the roller 11 in the direction of the opening 5. Moreover, the parallel plates 19' for guiding and discharging the support are formed by a plate fixed to the drawer 29 and by a plate fixed to the forward face of the element 1, the closure device 4 being provided only with the opening 5.

The micro-contact 32 detects any change of level, such that the discharge of the support 9 through the opening 5 provokes an actuation of the said micro-contact 32 and thus stoppage of the motor of the roller 11.

The invention has been described in connection with a device for dispensing cards, nevertheless any other flexible supports may also be distributed by means of such a device by simple adaptation of the compartments 2 and the openings 5 for the supports to be distributed, such as hand bills, road maps, etc. . .

The element 1 may be mounted on the ground or on a console or suspended from a wall or another support. Moreover, it is also possible to mount two elements 1, one against the other via their rear faces.

According to another characteristic of the invention, the element 1 may be mounted on a piece of furniture which can be rendered immobile or fixed to such a piece of furniture intended for storage of the supports 9 for resupplying the compartments 2.

Thanks to the invention, it is possible to dispense flexible supports with total security against theft or deterioration by bad weather or handling, without requiring surveillance personnel, or, in the case of selling, in a totally automatic manner.

It will be understood that the invention is not limited to the embodiment described and shown in the accompanying drawings. Modifications remain possible, particularly from the point of view of the construction of the various elements, or by substitution of equivalent techniques, without departing whatsoever from the scope of protection of the invention.

I claim:

1. Device for dispensing flexible supports, comprising a juxtaposition and superposition of compartments each enclosing a stack of flexible supports (9), means for the dispensing of individual supports by an assembly (3) for selection of and payment for flexible supports, and a closure (4) for said compartments, said closure having at an upper portion of each compartment (2), a dispensing opening (5), and below this opening (5) a housing (6) for the reception and display of a sample of the flexible supports (7) contained within the corresponding compartment (2), each compartment (2) having a drawer (29) introduced through a rear face of the device (1), the supports (9) being supported within the drawer on a movable base (30) against the action of springs (31), a drive roller (11) with a motor fixed against an upper wall of the compartment (2) and a micro-contact (32) controlling stoppage of the said motor, this micro-contact being disposed behind the roller (11) in the direction of the opening (5).

2. Device according to claim 1, in which parallel plates (19') for guiding and discharging the support are formed by a plate fixed to the drawer (29) and by a plate fixed to a forward face of the device (1), the closure (4) being provided only with the dispensing opening (5).

3. Device for dispensing flexible supports, comprising a juxtaposition and superposition of compartments each enclosing a stack of flexible supports (9), means for the dispensing of individual supports by an assembly (3) for selection of and payment for flexible supports, and a closure (4) for said compartments, said closure having, at an upper portion of each compartment (2), a dispensing opening (5), and below this opening (5) a housing, (6) for the reception and display of a sample of the flexible supports (7) contained within the corresponding compartment (2), each compartment (2) having a movable base (8) receiving the flexible supports (9) and urged by springs (10), said dispensing means (11) being in the form of a movably mounted drive roller, a forward inclined plate (12) pivotably mounted on the base of the compartment (2) and bearing, in a service position, against the base of an outlet hopper lip (13) connected to the dispensing opening (5) of the closure device (4), a movable access plate (14) also pivotably mounted on the base of the compartment (2) maintaining, in a closure position, the inclined plate (12) in said service position, and a rear push-plate (15) urged by a spring (16) and bearing on the packet of supports (9).

4. Device according to claim 3, in which the drive roller (11) is mounted on an end of an arm (17), the other end of which arm is connected in an upper portion of the compartment (2), and is provided with a coating (18) having a high friction coefficient.

* * * * *